US006589147B2

(12) United States Patent
Dominguez, Jr. et al.

(10) Patent No.: US 6,589,147 B2
(45) Date of Patent: Jul. 8, 2003

(54) LIGHTWEIGHT FORMER AND FORMER ASSEMBLY

(75) Inventors: John Dominguez, Jr., Pasadena, TX (US); John Dominguez, III, Pasadena, TX (US); Ben Dominguez, LaPorte, TX (US); Kenneth Dishon, Richmond, TX (US)

(73) Assignee: J & F Business, Inc., Pasadena, TX (US)

( * ) Notice: Subject to any disclaimer, the term of this patent is extended or adjusted under 35 U.S.C. 154(b) by 67 days.

(21) Appl. No.: 09/948,259

(22) Filed: Sep. 8, 2001

(65) Prior Publication Data

US 2003/0050166 A1 Mar. 13, 2003

(51) Int. Cl.[7] ..... B31C 1/00

(52) U.S. Cl. ..... 493/269; 493/292; 493/295; 493/296

(58) Field of Search ..... 493/269, 292, 493/295, 296

(56) References Cited

U.S. PATENT DOCUMENTS 2,969,627 A * 1/1961 Leasure ..... 53/451
2,982,334 A * 5/1961 Cooper et al. ..... 100/305
3,042,103 A * 7/1962 McDevitt et al. ..... 156/466
3,486,424 A * 12/1969 Tanner ..... 493/468
3,636,826 A * 1/1972 Bowen et al. ..... 493/417
3,935,048 A * 1/1976 Rucker ..... 156/203
4,532,754 A * 8/1985 Hokanson ..... 53/451
4,950,345 A * 8/1990 Kreager et al. ..... 156/203

* cited by examiner

*Primary Examiner*—Scott A. Smith
*Assistant Examiner*—Nathaniel Chukwurah
(74) *Attorney, Agent, or Firm*—The Law Offices of Coe F. Miles, P.C.

(57) ABSTRACT

A former whose wing component incorporates periodic openings, a tube component (that may, or may not, incorporate periodic openings) and a base component (that is shaped to conform substantially to the former's tube geometry) is described. Such a former, may be significantly less heavy than prior art formers (for a given size package) while simultaneously providing improved performance and durability. A former assembly that includes the former, a cross-bar, a top-plate and spacers is also described. Each of the cross-bar, top-plate and spacers may use aluminum and/or incorporate hollowed pockets to further reduce the assemblies weight.

24 Claims, 7 Drawing Sheets

LIGHTWEIGHT FORMER AND FORMER ASSEMBLY

BACKGROUND

The invention relates generally to product packaging systems and, more particularly but not by way of limitation, to a bag former and former assembly for use in a packaging system.

As shown in FIG. 1, a product packaging system 100 comprising three major components: the product 105 to be packaged; packaging material 110 from which packages are formed; and former 115. Product 105 may comprise virtually any material including, for example, liquids, powders, solids and bulk material. Package material 110 is typically a thin film with text and graphics that identify the product (e.g., potato chips or coffee) and supplier (e.g., Company XYZ). Former 115 is an assembly that manipulates package material 110 into the desired shape (e.g., a rectangular or elliptical bag) and forms the package's seal, while the packaging system itself provides the product and actually seals package material 110 to form an enclosed volume (packages 120).

FIG. 2 shows a typical prior art longitudinal-type packaging system 200. As shown, product 105 and packaging material 110 is introduced to former 115 where material 110 is shaped and aligned by wing 205 to conform about product filing tube 210 and to form a seam. The seam is longitudinally sealed by sealing device 215 so that material 110 forms a cylinder 220. Feeding device 225 pulls packaging material 110 (specifically cylinder 220) downward so that sealing/cutting device 230 seals cylinder 220 to form product package 120.

For economic reasons, it is important that packaging systems such as 100 and 200 operate at high speeds and for long periods of time. This, in turn, requires that former 115 be constructed of material that is mechanically strong (e.g., rigid), extremely wear resistant, not susceptible to corrosion and presents low resistance to packaging material 110. The latter is important because as packaging material 110 is pulled over wing 205 component wear can, over time, result in a former 115 that creates uneven seams or wrinkles, creases or tears packaging material 110 as it is pulled over the wing's 205 surface.

Former 115 is typically designed to produce a package having a predetermined size and shape. For example, a first former may be designed to produce rectangular bags having a width of four (4) inches for use in small snack or candy products. A second former may be designed to produce elliptical bags having a width of eight (8) inches for use with breakfast cereal products. Still another former may be designed to produce bags having a width of twenty four (24) inches to package industrial/commercial frozen food. Accordingly, when a different size package (for the same or a different product) is needed, former 115 is replaced by a different former designed to produce a package having the new/correct size. For the reasons discussed above, typical former assemblies are fabricated out of solid stainless steel and, as a result, are quite heavy. Thus, it is often difficult for a worker to change the former because of the former's weight. Large formers often require multiple personnel or a small crane to change. This, in turn, reduces the amount of time the packaging system can be used to package product. This is especially true for larger formers such as those used to package, for example, industrial food packages (e.g., commercial-size containers of frozen foods).

Thus, it would be beneficial to provide a former that is wear and corrosion resistant, presents low friction to packaging material and yet is significantly lighter than current formers.

SUMMARY

In one embodiment the invention provides a former that includes a wing having a concave surface with periodic openings, a tube coupled to the wing along a first edge to form a crown and a base coupled to the tube along a second edge of the tube and conforming substantially to the shape of the tube and further adapted to couple to a packaging system. The tube may be designed to facilitate fabrication of substantially any shape package such as, for example, a rectangle, a square, a circle or an ellipse. In another embodiment of the invention, the tube includes periodic openings. In yet another embodiment of the invention, the former may include a cross-bar (coupled to the base and adapted to attach to a packaging system), a top-plate (coupled to the wing substantially parallel to the plane of the cross-bar and adapted to attach to a packaging system) and spacers that interconnect the cross-bar and top-plate. The wing may be fabricated from 2-WL rigidized stainless steel, the tube and base from stainless steel and the cross-bar, top-plate and spacers from anodized aluminum or other lightweight material. In addition, the cross-bar and top-plates may incorporate hollowed-out regions. Finally, a former in accordance with the invention may include a secondary product inlet to allow the introduction of additional material (other than the primary product) into a package formed by the former.

A former in accordance with the invention may be substantially less heavy than a prior art former designed to fabricate the same package while simultaneously providing improved operating performance, vis a vis the ability to generate packages with uniform seams, and equal or improved durability.

DETAILED DESCRIPTION

Figure 1:
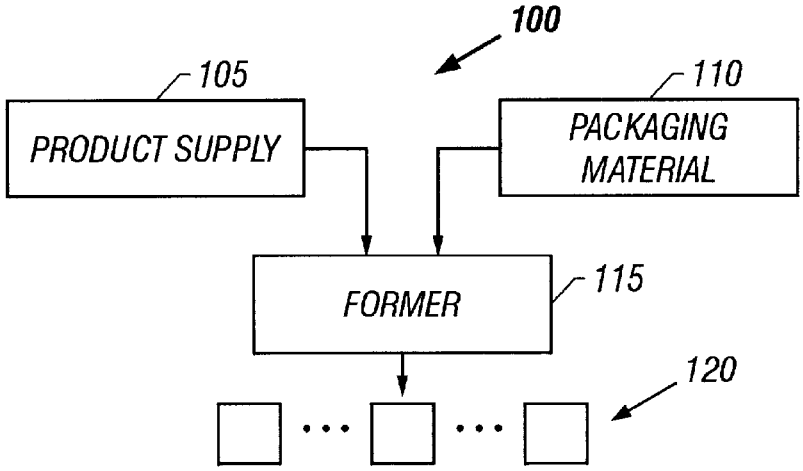
FIG. 1 shows a block diagram of a product packaging system.
Figure 2:
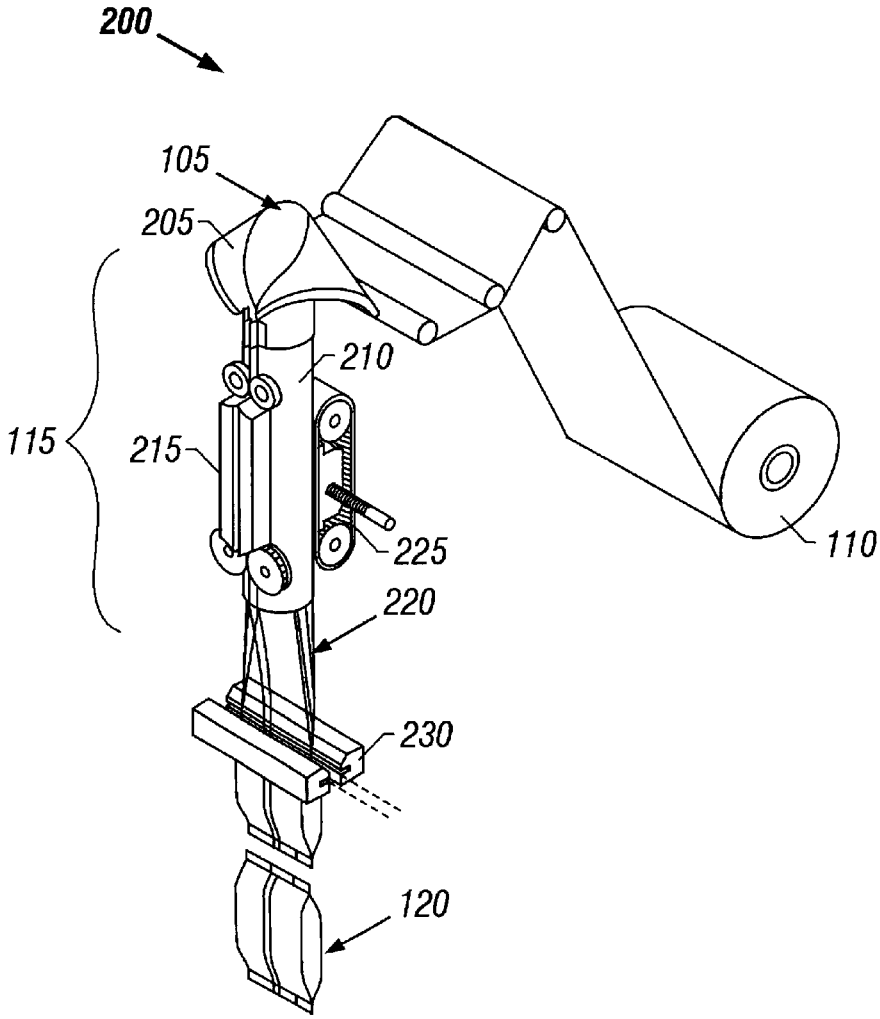
FIG. 2 (Prior Art)
FIG. 2 shows a longitudinal-type packaging system.

A lightweight former and former assembly is described. The following embodiments of the invention are illustrative only and are not to be considered limiting in any respect.

In accordance with one embodiment of the invention (see FIG. 3), former 300 comprises wing 305 having periodic openings 310 therein, tube 315 having periodic openings 320 therein and base ring 325. In combination, wing 305, tube 315 and base ring 325 provide a former that is significantly less heavy than prior art formers while simultaneously providing superior performance (e.g., the ability to generate packages with uniform seams) and that is at least equal in terms of durability.

Figure 3:
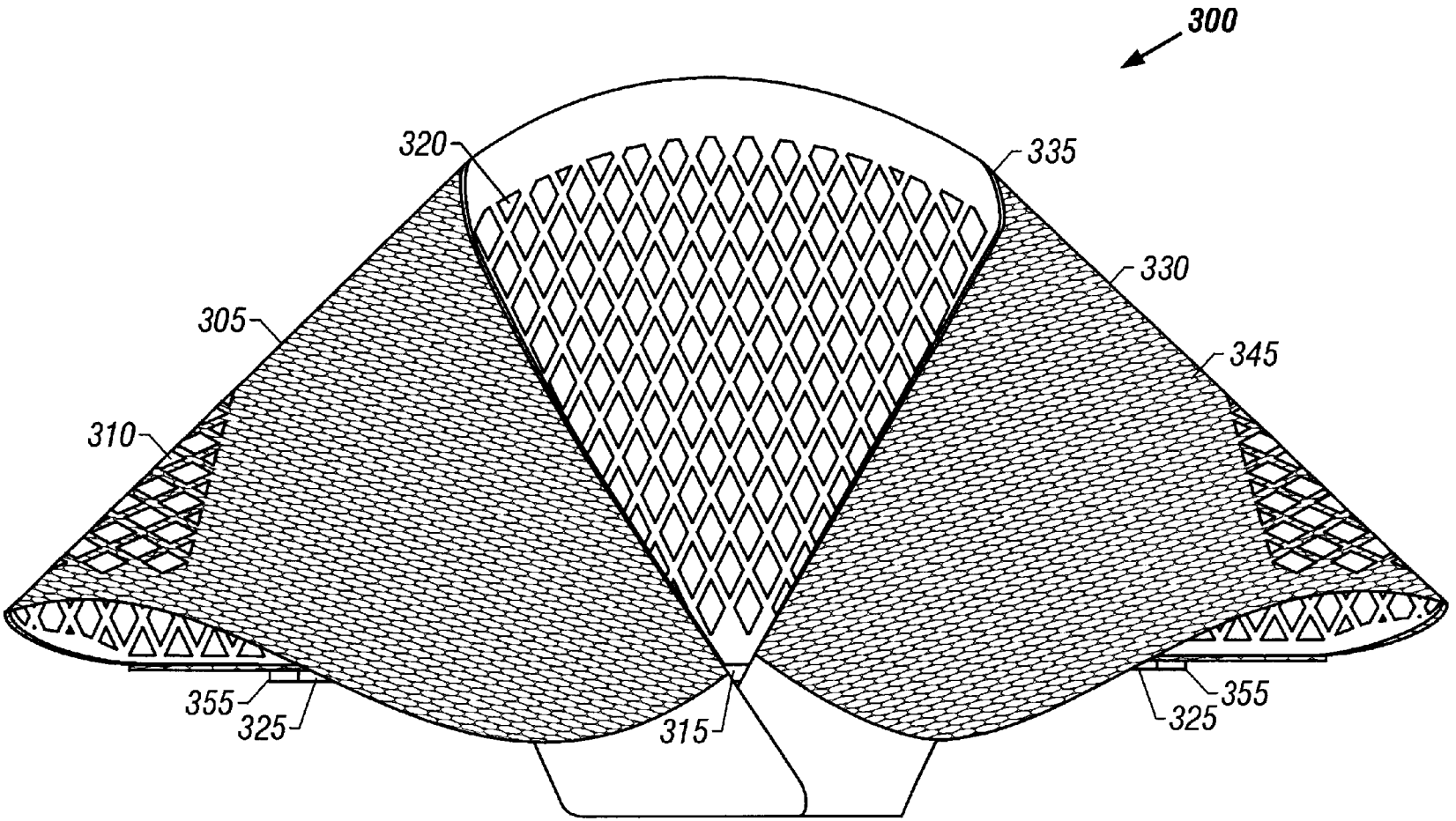
FIG. 3 shows an isometric view of a former in accordance with one embodiment of the invention.

Wing 305 is conformed into a standard shape to guide packaging material along surface 330, over crown 335 and down tube 315. (Product is typically supplied to a formed package through a product supply tube located "inside" tube 315, not shown in FIG. 3.) Periodic openings 310 not only reduce the weight of wing 305, they can also improve its operating performance by reducing the drag (friction) experienced by packaging material being drawn over the wing. Reduced drag, in turn, reduces the wear experienced by former 300 which, ultimately, allows former 300 to form more consistently uniform seals for a longer period than prior art formers. Periodic openings 310 provide reduced drag through at least two mechanisms. First, periodic openings 310 reduce drag by reducing the amount of surface area over which packaging material is drawn. Second, periodic openings 310 allow air to flow from the wing's under-side (that side facing tube 315) toward surface 330 creating a cushion of air on which packaging material may "float" as it is drawn into former 300. In the embodiment of FIG. 3, substantially all of surface 330 is dimpled with a pattern 345 that further facilitates the movement of packaging material. In one embodiment, wing 305 is constructed of 2-WL rigidized stainless steel. Other dimpling patterns, or no dimpling pattern, may also be used. One of ordinary skill in the art will recognize that periodic openings 310 may be formed using various shapes. For example, circles, ellipses, squares and rectangle openings may also be used. In addition, periodic openings 310 could encompass more or less of wing surface than shown in FIG. 3. An important aspect of periodic openings 310 is that they are sufficiently numerous as to reduce the wing's weight and improve its operating characteristics, but not so numerous as to adversely effect (i.e., reduce) the wing's strength and rigidity. Both wing strength and rigidity are important to ensure that packaging material flows evenly, smoothly and uniformly over the wing.

Tube 315 couples to wing 305 on one edge, forming crown 335, and to base ring 325 along a second edge. Periodic openings 320 reduce the tube's weight and the drag experienced by packaging material as it is drawn around the tube during package formation (compared to prior are former tubes). Thus, periodic openings 320 are used for the same purposes, provide the same benefits (reduced weight and improved operational performance), and have the same limitations regarding strength and rigidity as do periodic openings 310 in wing 305.

Base ring 325 is coupled to tube 315 to provide a substantive base for and is further coupled to a folded flap of wing 305 to provide additional rigidity (see below for a discussion of element 430 in FIG. 4A). Base ring 325 further allows former 300 to be coupled to a packaging systems through any convenient means such as, for example, bolts via bolt-holes 355. Base rings in accordance with the invention are formed into a shape complementary to the shape of the package to be formed (in FIG. 3, a cylinder having a circular cross-section) and are only as substantive as needed to provide structural stability and coupling to a packaging system. In prior art formers, the base element is typically a large rectangular plate and is substantially more massive than that of base ring 325.

In one embodiment, wing 305, tube 315 and base ring 325 are manufactured from stainless steel. Periodic openings 310 and 320 are fabricated via laser cutting techniques. Crown 335 is formed by soldering using high silver content solder, and tube 315 is coupled to base ring 325 by welding. One of ordinary skill in the art will recognize that other materials, fabrication techniques and coupling materials could be used. For example, a composite material rather than a metal could be used in one or more of the wing, tube and base ring elements. In addition, periodic openings could be applied to wing 305 and not to tube 315, or versa visa. Further, periodic openings could be formed using water jet, stamping, milling or such other techniques as may be desired or feasible depending upon the material used for the underlying element (wing, tube or base ring).

Figure 4A:
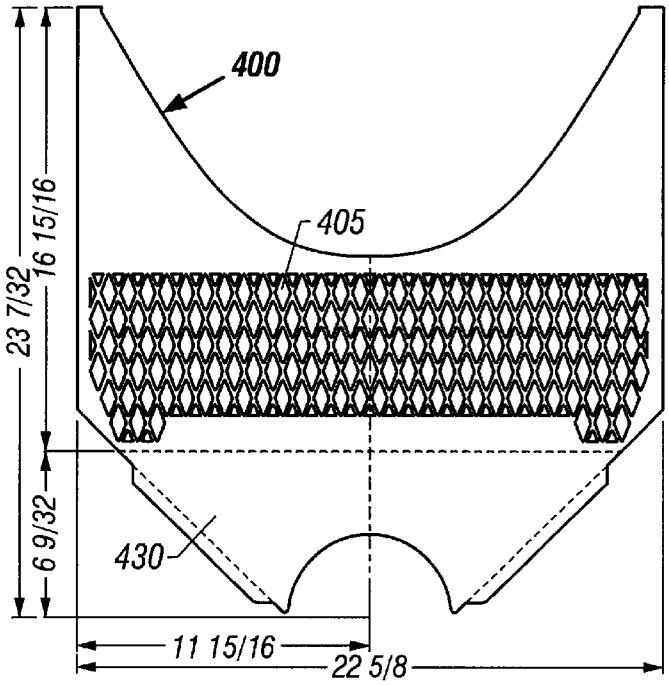
FIGS. 4A through 4C show engineering-style diagrams for the former of FIG. 3. (All measures are in inches.)
Figure 4B:
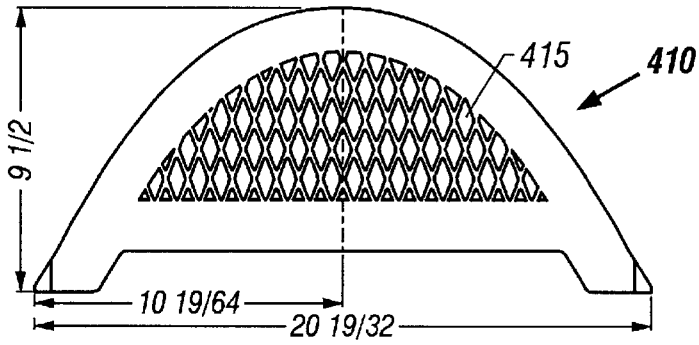
Figure 4C:
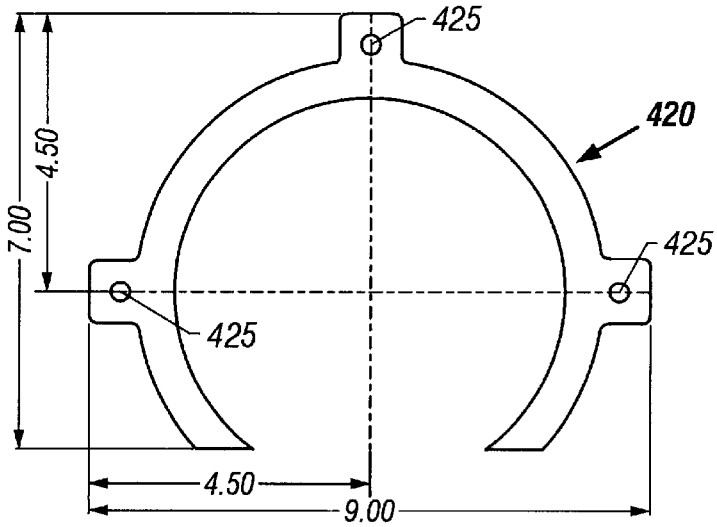

FIGS. 4A through 4C show engineering-style diagrams for a former in accordance with FIG. 3 that has been designed to produce a package having a 9.646 inch width. Referring to FIG. 4A, wing 400 is manufactured from 24 gauge 2-WL rigidized stainless steel and periodic openings 405 are restricted to a specified region of the wing element. Referring now to FIG. 4B, tube 410 is manufactured from 16 gauge stainless steel and periodic openings 415 are restricted to the center portion of its surface. Finally, FIG. 4C shows base ring 420 having a substantially circular shape (conforming to the shape of tube 410) and includes three (3) bolt holes 425 to allow coupling to a packaging system. The region denoted in FIG. 4A as 430 is folded (along the horizontal dashed line) and attached to tube 410 to provide additional rigidity to the former.

Figure 5A:
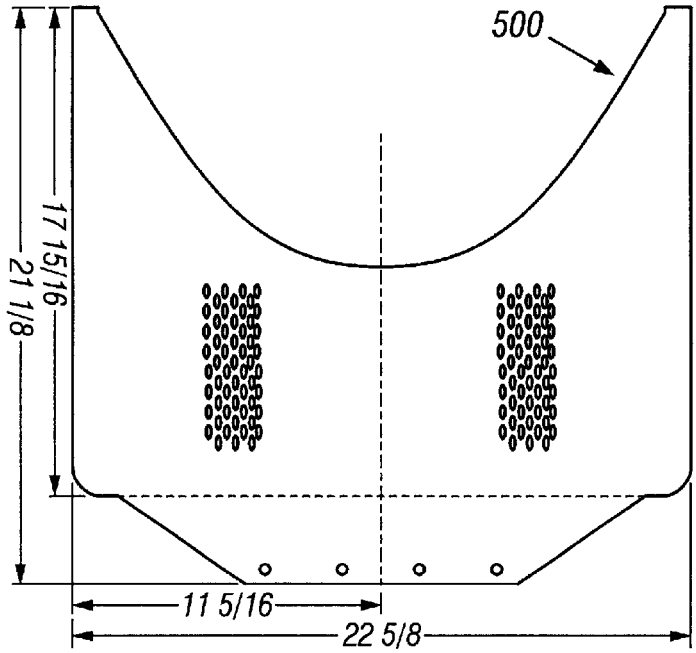
FIG. 5A (Prior Art)
FIGS. 5A through 5C show engineering-style diagrams for a prior art former. (All measures are in inches.)
Figure 5B:
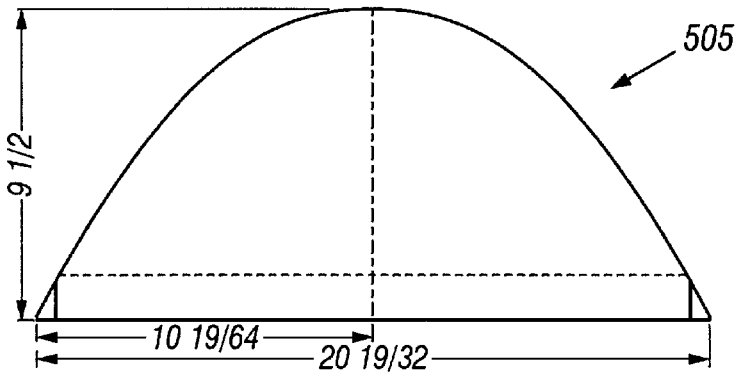
FIG. 5B (Prior Art)
Figure 5C:
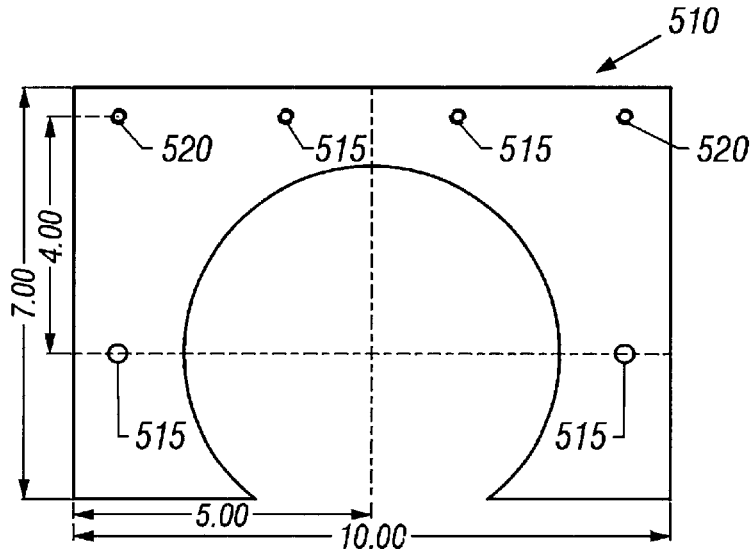
FIG. 5C (Prior Art)

By comparison, a prior art former designed to produce the same size packages as the former of FIGS. 3 and 4 are shown in FIGS. 5A through 5C. Referring to FIG. 5A, wing 500 is manufactured from 24 gauge 2-WL rigidized stainless steel and has no periodic openings. Referring now to FIG. 5B, tube 505 is manufactured from 16 gauge stainless steel and, similarly, has no periodic openings. A comparison of prior art tube 505 and tube 410, shows a tube in accordance with the invention may also have a notch at that edge not used to form the crown (i.e., the edge not coupled to the wing). This notching further reduces the weight of a former in accordance with the invention over prior art formers. Finally, FIG. 5C shows prior art base plate 510 incorporating bolt holes 515 that may be used to connect it to a packaging system. Prior art base plate 510 is substantially larger than base ring 420 in accordance with the invention. Combined, prior art wing 500, tube 505 and base plate 510 may be so significantly heavy that base plate 510 includes holes 520 for attachments to allow a small crane to move the former. While a comparison of FIGS. 4 and 5 highlight the structural differences between a former in accordance with the invention and a prior art former, they do not show the improved performance (through reduced drag) and longer life (through reduced wear) afforded by a former in accordance with the invention.

Figure 6B:
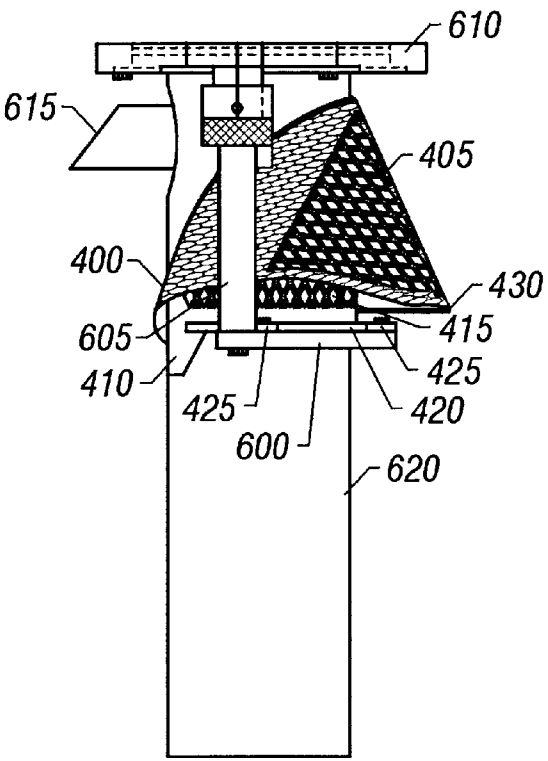
FIGS. 6A and 6B show a former assembly in accordance with one embodiment of the invention.
Figure 6A:
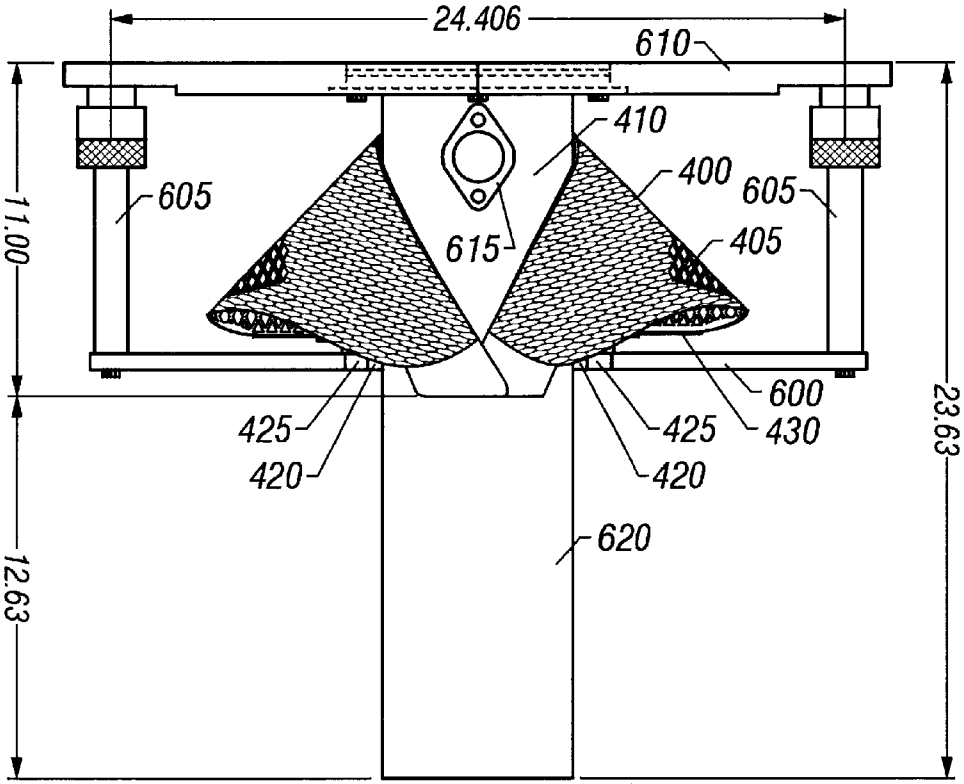
Figure 7A:
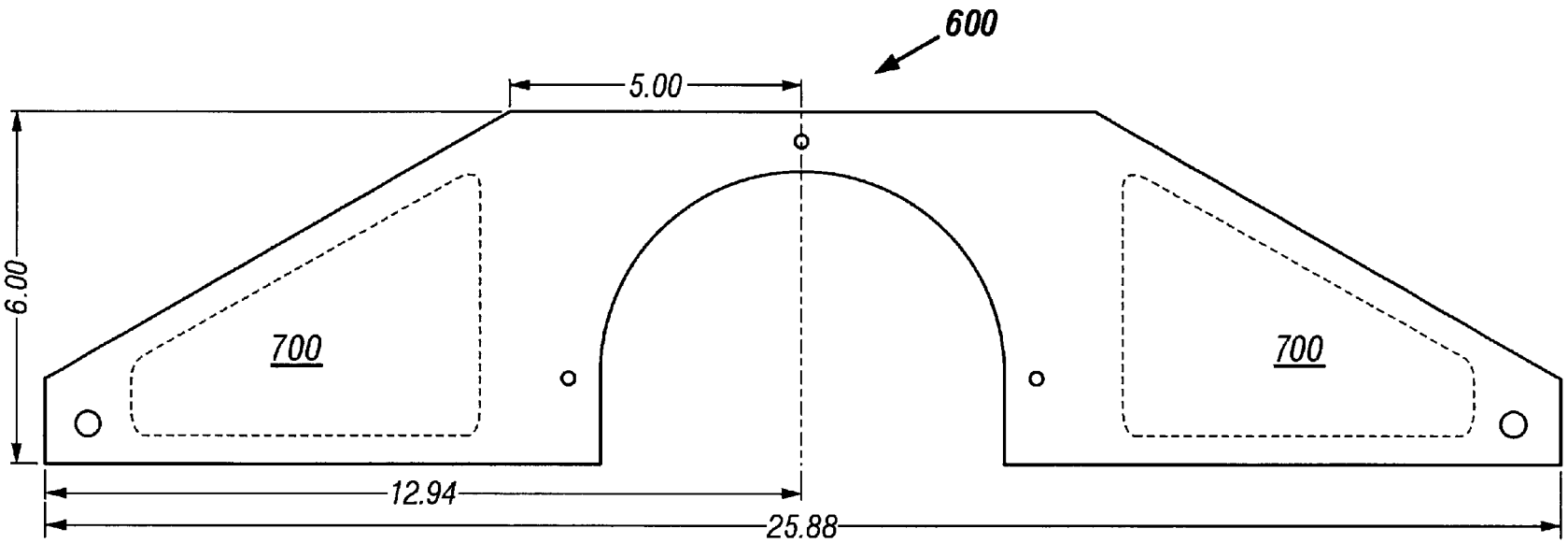
FIGS. 7A and 7B show engineering style diagrams for the cross-bar component of FIG. 6. (All measures are in inches.)
Figure 7B:
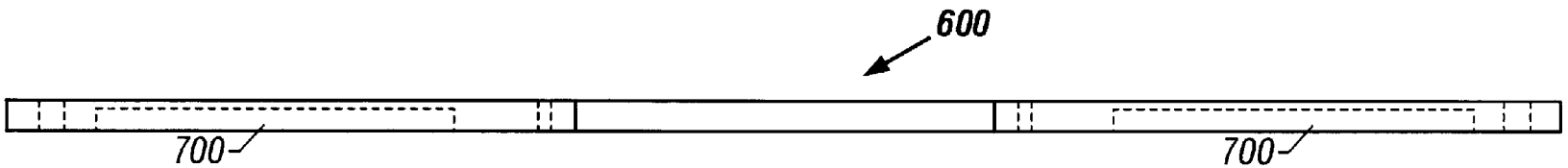
Figure 8A:
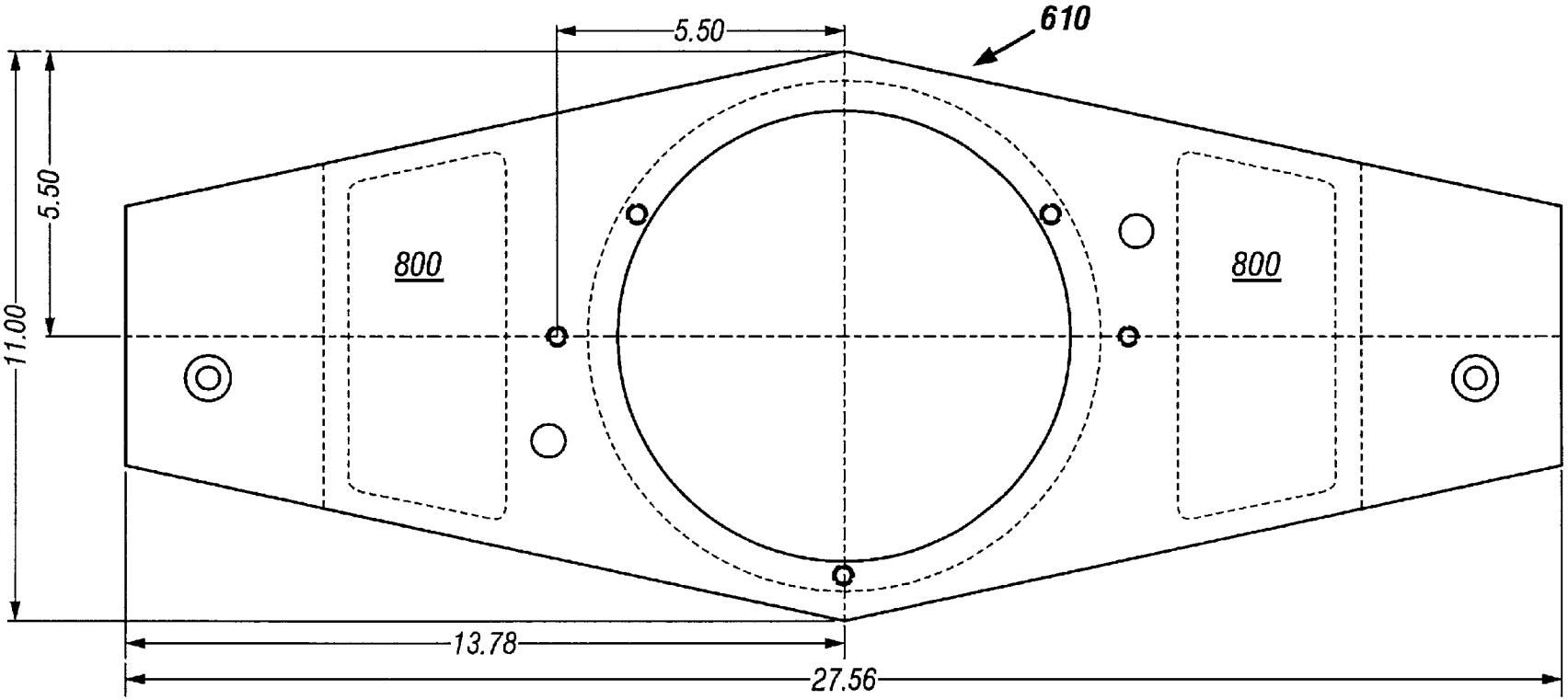
FIGS. 8A and 8B show engineering style diagrams for the top-plate component of FIG. 6. (All measures are in inches.)
Figure 8B:
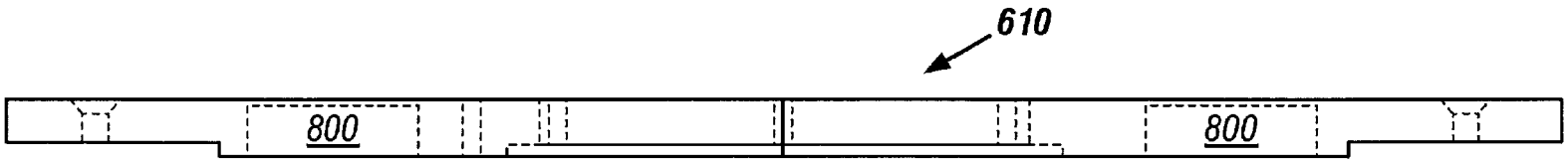

Referring to FIGS. 6A and 6B, one embodiment of a former assembly in accordance with the invention includes the basic former (see FIGS. 4A–4C) and cross-bar 600, spacers 605, top-plate 610, secondary product inlet 615, and product tube 620. Secondary product inlet 615 provides a means to introduce a secondary product into the package formed by former (comprising wing 400, tube 410 and base 420) such as, for example, a product coupon, a toy or a gaseous material (e.g., nitrogen). Product tube 620 provides a mechanism to deposit the product being packaged into the package. As shown in FIGS. 7 and 8, cross-bar 600 and top-plate 605 may incorporate hollow regions 700 and 800 that are designed to reduce the component's weight without adversely affecting its strength and rigidity. To further reduce weight over prior art former assemblies (typically fabricated using solid stainless steel), cross-bar 600 and top-plate 610 may be comprised of aluminum and, in particular, anodized aluminum. Similarly, spacers 605 may be fabricated from aluminum or anodized aluminum. One of ordinary skill in the art will recognize that a former assembly may include a former only (see FIGS. 3 and 4), a former with one or more cross-bars 600, or a former with one or more cross-bars 600, a plurlaity of spacers 605 and one or more top-plates 610.

Table 1 shows the weight difference for the different elements of a former assembly made in accordance with the invention as compared to a comparable prior art former assembly. The weights listed in Table 1 correspond to a former assembly designed to produce a package having a 9.646 inch width and using the materials described with respect to FIGS. 4 and 6. The prior art former assembly is one designed for an identical package, but using industry standard solid stainless steel components.

TABLE 1

Weight Comparison Between an Illustrative Former Assembly In accordance with the invention and a Prior Art Former Assembly

| Component | Weight of Inventive Embodiment (lbs) | Weight of Prior Art Embodiment (lbs) | Weight Saved By Invention (%) |
|---|---|---|---|
| Former | 3.8 | 8.6 | 55.8 |
| Cross-Bar | 3.0 | 4.4 | 31.8 |
| Spacers | 2.8 | 8.0 | 65.0 |
| Top-Plate | 10.8 | 14.4 | 25.0 |
| Total | 20.4 | 35.4 | 42.4 |

It is emphasized that not only does the invention result is a significantly less heavy former/former assembly than prior art techniques, but also a former that provides significantly improved performance and durability (see discussion above regarding FIG. 3).

While the invention has been disclosed with respect to a limited number of embodiments, numerous modifications and variations will be appreciated by those skilled in the art. For instance, a former in accordance with one embodiment of the invention may incorporate periodic openings in the wing only, the tube only, or a combination thereof. In addition, a former in accordance with one embodiment of the invention may include more, or fewer, periodic openings than that illustrated in the embodiment of FIGS. 3, 4 and 6. Further, a former in accordance with another embodiment of the invention may include a means of introducing a secondary product into the package formed by the former. One example secondary product is a food coupon. A second example of a secondary product is a small toy. It is intended, therefore, that the following claims cover all such modifications and variations that may fall within the true sprit and scope of the invention.

What is claimed is:

1. A former assembly, comprising:

a stainless steel wing having a curved edge and a concave surface, the concave surface having substantially plain periodic openings;

a stainless steel tube having a curved edge coupled to the curved edge of the wing to form a crown, a substantially straight edge and a surface having periodic openings; and a stainless steel base coupled to the substantially straight edge of the tube and further adapted to couple to a packaging machine.

2. The former assembly of claim 1, further comprising an anodized aluminum cross-bar coupled to the base distal to the tube, the cross-bar substantially parallel to the plane of the base and adapted to couple to a packaging system.

3. The former assembly of claim 2, further comprising:

an anodized aluminum top-plate substantially parallel to the plane of the cross-bar and adapted to couple to a packaging system; and a plurality of anodized aluminum spacers that couple the cross-bar to the top-plate.

4. The former assembly of claim 3, wherein each of the cross-bar and top-plate have at least one region from which material comprising the cross-bar and top-plate has been removed to form a pocket.

5. The former assembly of claim 1 further comprising a secondary product inlet coupled to the tube and adapted to allow material to be introduced into a package formed by the former.

6. The former assembly of claim 1 wherein the wing comprises 2-WL rigidized stainless steel.

7. The former assembly of claim 1, wherein the tube has a cross-section selected from the group consisting of a circle, an ellipse, a rectangle and a square.

8. A former, comprising:

a wing having a curved edge and a concave source, the concave surface having substantially plain periodic openings;

a tube having a curved edge coupled to the curved edge of the wing to form a crown, a substantially straight edge and a surface; and a base coupled to the substantially straight edge of the tube and further adapted to couple to a packaging machine.

9. The former of claim 8, wherein the wing comprises 2-WL rigidized stainless steel.

10. The former of claim 8, wherein the tube surface has periodic openings.

11. The former of claim 8, wherein the tube comprises stainless steel.

12. The former of claim 8, further comprising a cross-bar coupled to the base distal from the tube, the cross-bar substantially parallel to the plane of the base and adapted to couple to a packaging system.

13. The former of claim 12, wherein the cross-bar comprises anodized stainless steel.

14. The former of claim 12, wherein the cross-bar has at least one region from which material comprising the cross-bar has been removed to form a pocket.

15. The former of claim 12, further comprising:

a top-plate coupled to the wing and substantially parallel to the plane of the cross-bar; and a plurality of spacers that couple the cross-bar to the top-plate.

16. The former of claim 15, wherein the top-plate has at least one region from which material comprising the top-plate has been removed to form a pocket.

17. The former of claim 15, wherein the cross-bar and the spacers comprise anodized aluminum.

18. The former of claim 8, wherein the tube has a cross-section selected from the group consisting of a circle, an ellipse, a rectangle and a square.

19. A former, comprising:

a wing having a concave surface with substantially plain periodic openings;

a tube coupled to the wing along a first edge to form a crown; and a base coupled to the tube along a second edge of the tube and conforming substantially to the shape of the tube and further adapted to couple to a packaging system.

20. The former of claim 19, wherein the wing comprises 2-WL rigidized stainless steel.

21. The former of claim 19, wherein the tube further comprises periodic openings.

22. The former of claim 19, wherein the tube has a cross-section selected from the group consisting of a circle, an ellipse, a rectangle and a square.

23. The former of claim 19, wherein the tube and the base comprise stainless steel.

24. The former of claim 19, further comprising a secondary product inlet coupled to the tube.

* * * * *